US007591208B2

(12) United States Patent
Cole

(10) Patent No.: US 7,591,208 B2
(45) Date of Patent: Sep. 22, 2009

(54) MULTI-COUPLING ADJUSTABLE TOOLS

(76) Inventor: Charles A. Cole, 3621 Trail View Dr., Plano, TX (US) 75074

( * ) Notice: Subject to any disclaimer, the term of this patent is extended or adjusted under 35 U.S.C. 154(b) by 305 days.

(21) Appl. No.: 11/434,732

(22) Filed: May 16, 2006

(65) Prior Publication Data

US 2006/0266167 A1 Nov. 30, 2006

Related U.S. Application Data

(60) Provisional application No. 60/682,256, filed on May 18, 2005.

(51) Int. Cl.
*B25B 23/16* (2006.01)

(52) U.S. Cl. ..... 81/177.8; 403/103

(58) Field of Classification Search ..... 81/177.7–177.8; 403/91–94, 96–97, 103, 108
See application file for complete search history.

(56) References Cited

U.S. PATENT DOCUMENTS 1,431,389 A * 10/1922 Frisz ..... 81/177.7
2,921,773 A * 1/1960 Hoelzer ..... 254/129
6,412,374 B1 * 7/2002 Hsieh ..... 81/177.7

* cited by examiner

*Primary Examiner*—D. S Meislin

(57) ABSTRACT

Adjustable tools which may be linked through a plurality of couplings connected by links so that the tool and the handle and the links are rotatable relative to each other in a released condition and locked relative to each other in a locked position. The tool, the handle and the links may thus be adjusted to have the tool at any desired orientation to the handle and in a locked position in that orientation.

19 Claims, 6 Drawing Sheets

MULTI-COUPLING ADJUSTABLE TOOLS

RELATED CASES

This application is entitled to and hereby claims the benefit of the filing date of Provisional Application Ser. No. 60/682,256 filed May 18, 2005 entitled "Multi-Coupling Adjustable Tools" by Charles A. Cole.

FIELD OF THE INVENTION

The present invention relates to adjustable tools, which may be linked through a plurality of coupling and links so that the tool and the handle are adjustable relative to each other to form a tool which is tailored to access difficulty accessible areas.

BACKGROUND OF THE INVENTION

Many tools have been proposed which provide for adjustable wrenches. One such tool is shown in U.S. Pat. No. 5,419,221 issued May 30, 1995 to James Cole. This patent discloses a wrench which has a splined pin fixed to the head of the wrench with the handle being moveable between an upper released position and a lower locked position. This wrench has the disadvantage that the pin protrudes for a substantial distance above the wrench in all instances. This patent is hereby incorporated in its entirety by reference.

U.S. Pat. No. 5,775,184 issued Jul. 7, 1998 to James Cole discloses a similar wrench. U.S. Pat. Nos. 5,820,288, 6,000,299 and 6,161,982 also relate to tools which use splined connections in various ways. These patents are further incorporated in their entirety by reference.

Other variations have been proposed which require a smooth pin positioned on the wrench head with the pin being used to engage an opening in the handle which includes flat surfaces moveable into engagement at various positions to lock the wrench and the handle into fixed positions. These wrenches also require that the pin protrude a substantial distance above the top of the wrench.

All of these wrenches are subject to certain shortcomings. Many of the wrenches previously developed to have releasable coupling involve the use of springs so that the wrench may be released only while the pin is held in a particular position from which it returns when released. This results in certain disadvantages, particularly with respect to the protrusion of elements from the sides or tops of the wrenches or the tools. Accordingly, a continued effort has been directed to the development of simpler, more rugged and less protrusive coupling systems for tools.

In particular, all of these wrenches permit the rotation of a tool head, referred to herein primarily as a wrench head, through up to 360 degrees relative to a wrench handle. While this offers many advantages with respect to accessing difficultly reachable bolts and the like, it is found that in some instances bolts are located in areas which cannot be reached, even by the adjustment of the orientation of the wrench head to the handle. Similar considerations apply to pry bars and other tools.

In some instances areas are desirably accessed which are simply beyond the reach of tools which have a rotatable head relative to the handle.

Accordingly, a continuing effort has been directed to the development of tools which can be tailored to a desired configuration to reach difficultly accessible areas for contacting such areas with a tool as required.

SUMMARY OF THE INVENTION

According to the present invention, an adjustable tool wherein a plurality of couplings and at least one link are positioned between a tool handle and a tool, the tool comprising: a first member connected at a first coupling to a first link so that the first member and the first link may be coupled to be rotatable relative to each other or so that the first member and the first link are locked relative to each other; at least one additional link connected to the first link and at least one second coupling so that the first link and the at least one additional link are coupled to be rotatable relative to each other or so that the first link and the at least one additional link are locked relative to each other; and, a second member connected to a terminal link at a terminal coupling so that the terminal link and the second member are rotatable relative to each other or so that the terminal link and the second member are locked relative to each other.

BRIEF DESCRIPTION OF THE DRAWINGS

FIG. 1(*a*) schematically shows a wrench including a plurality of couplings, according to the present invention;

FIG. 1(*b*) shows a wrench, including a plurality of couplings which has been tailored to access a difficultly accessible area;

FIG. 3(*a*) is an end view of a first end of the pin of FIG. 3;

FIG. 3(*b*) is an end view of a second end of the pin shown in FIG. 3;

FIG. 3(*c*) is a cross-sectional view of an end cap suitable for use on either end of the pin shown in FIG. 3;

DESCRIPTION OF PREFERRED EMBODIMENTS

In the discussion of the Figures, the same numbers will be used throughout to refer to the same or similar components.

In the practice of the present invention, a large number of coupling systems may be used. For instance, those coupling systems discussed in the Background are useful with the subject invention. It is preferred however that couplings which do not have protruding parts extending beyond the edges of the coupling and couplings which do not require that the coupling be spring released to position a coupling in a releasable position be used. One preferred coupling is shown in FIGS. 3-7.

Figure 1:
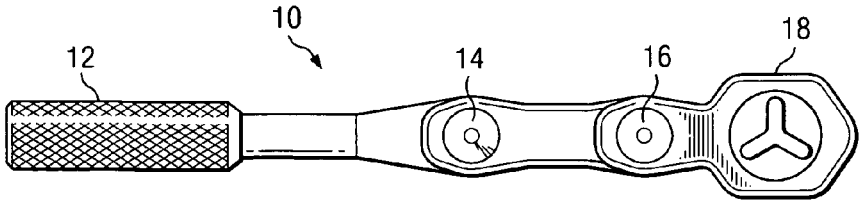
FIG. 1. schematically shows a ratchet wrench, including a multi-coupling according to the present invention.
Figure 1A:
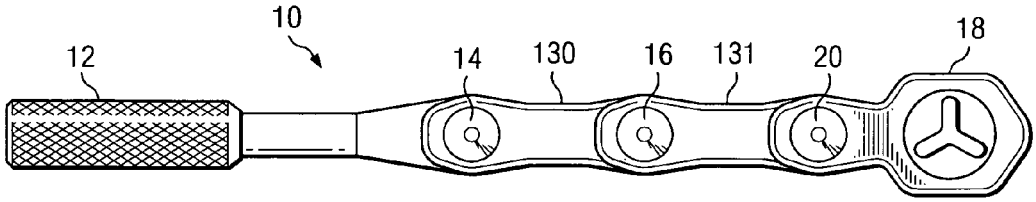
Figure 1B:
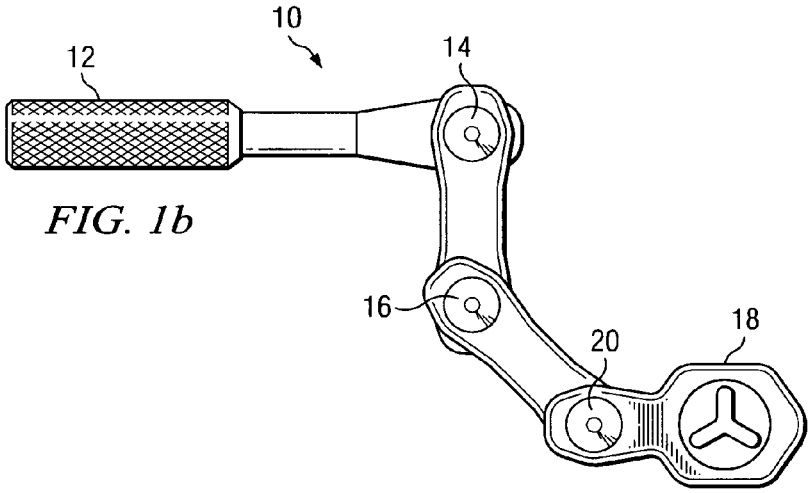

In FIG. 1 an adjustable wrench, according to the present invention, is shown. The wrench comprises a handle 12 having a coupling 14 between the handle and a ratchet 16 and having a ratchet head 18. A selector 20 is positioned on top of the ratchet, as well known to those skilled in the art.

In FIG. 1(*a*) a more detailed showing of the ratchet head is illustrated, particularly showing a mating shaft 22 for engagement with a tool, as well known to the art.

Figure 2:
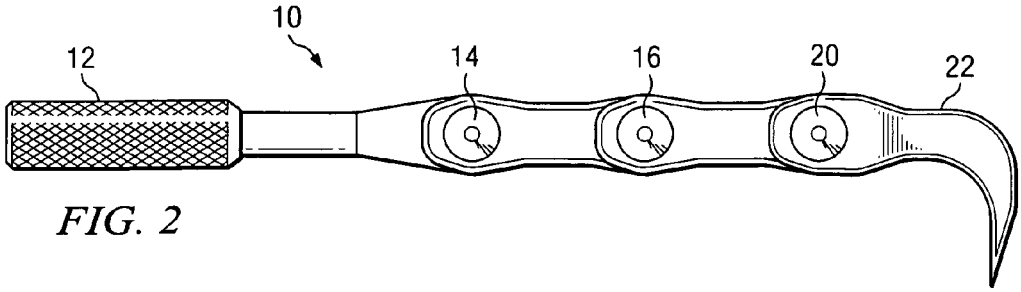
FIG. 2 schematically shows a pry bar having a plurality of couplings.

In FIG. 2 a similar device is shown except that the tool connected to the handle by the coupling 14 is a pry bar 24.

Figure 3:
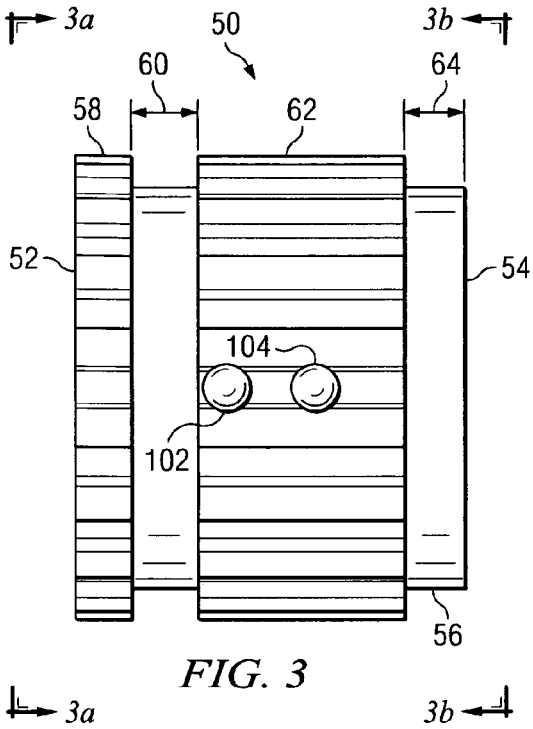
FIG. 3 is a schematic diagram of a pin, according to the present invention.
Figure 3A:
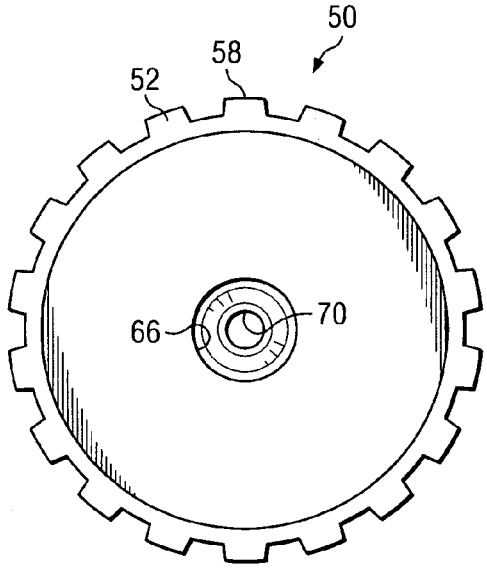
Figure 3B:
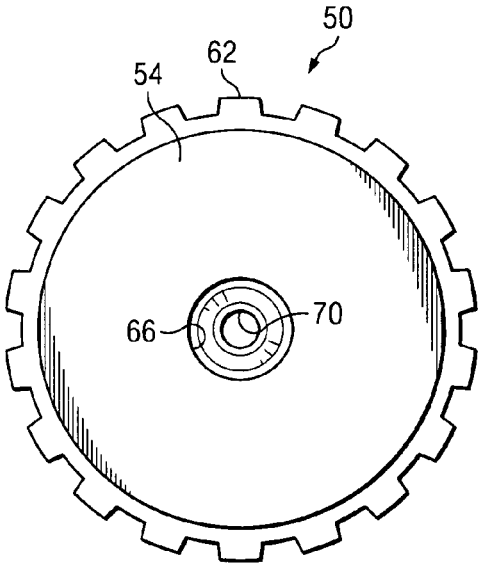
Figure 3C:
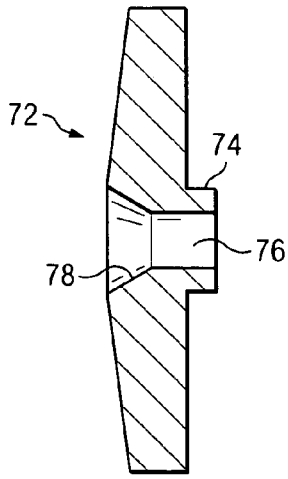

In FIG. 3 a pin useful in the adjustable tool of the present invention is shown. The pin comprises a pin 50 having a first end 52, a second end 54 and an outside 56. The pin also includes on its first end 52 on its outside, a first row 58 of splines. A first space 60 slightly wider than the first row 58 of splines is positioned next to the first row of splines. A second row of splines 62 is somewhat wider and is positioned adjacent to the first space 60. A second space 64 is positioned adjacent to the edge of the second row of splines 64 and adjacent to the second end 54. The pin also includes two ball bearings 104 and 106, which in the assembled wrench are positioned in holes in the second row of splines and maintained in an outwardly biased position by springs positioned beneath the ball bearings in the holes, as known to the art. Desirably the holes are positioned in valleys between splines. In FIG. 3(*a*) an end view of the first end 52 is shown as including a first row of splines 58 on its outside and on it's inside is a recess 66 dimensioned to receive protrusion 74 as seen in FIG. 3(*c*), and screw receptacle 70.

In FIG. 3(*b*) an end view of the second end 54 is shown and is similar to the end view of the first end 52, except that the splines on the outside are the outside of the second row of splines 62. Similarly to end view of the first end 52, on it's inside is (i) a recess 66 dimensioned to receive protrusion 74 as seen in FIG. 3(*c*), and screw receptacle 70.

End caps are typically used with the pin, with end caps being shown in FIG. 3(*c*). An end cap includes a protrusion 74, which mates with recess 66 and is formed for connection to the first and second ends by a screw (not shown) which is seated in a bevel 78 and positioned through a screw opening 76 into screw receptacle 70.

Figure 4:
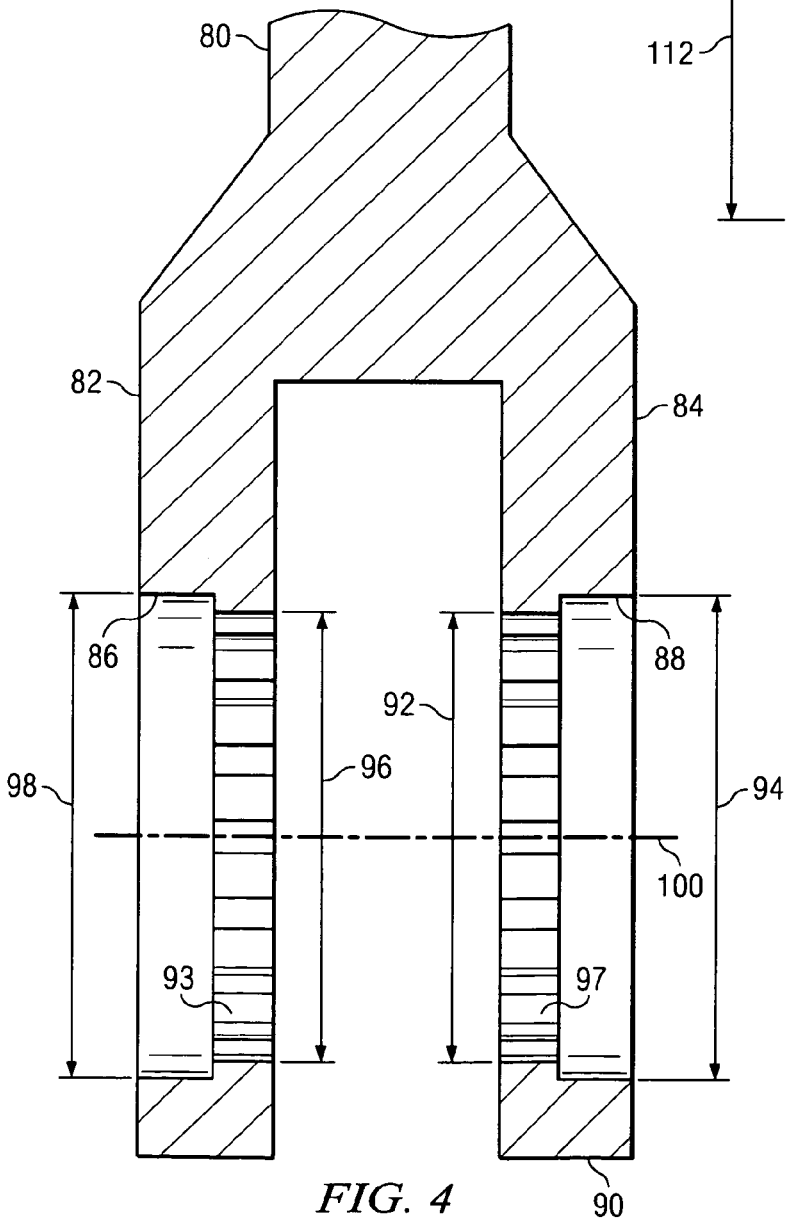
FIG. 4 is a schematic cross-sectional diagram of a first member for connection at a coupling of the present invention.

In FIG. 4 a first member 80 is shown and includes a first extension 82 and a second extension 84. These extensions are spaced to receive, between the extensions a second member 106. First member 80 includes first extension 82, including a first receptacle 86 and second extension 84, including a second receptacle 88. The receptacles are located in a first end 90 of the first member. First receptacle 86 has an inside circumference 92 with a first receptacle row of splines 93 being located on inside circumference 92. Outside circumference 94 of receptacle 86 is as shown. A second receptacle row of splines 97 is positioned on an inside circumference 96 of second receptacle 88. The receptacles have a common axis 100.

Figure 5:
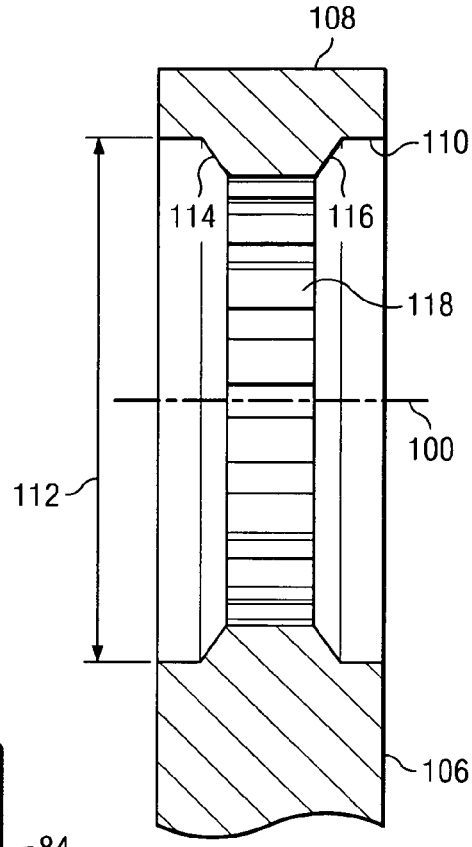
FIG. 5 is a schematic diagram of a mating member for junction to the member shown in FIG. 4.

In FIG. 5 a second member 106 is included and is adapted to matingly engage first member 80. A second end of second member 108 includes a third receptacle 110, which has an inside circumference 112 and includes a first and a second bevel 114 and 116, respectively around its outer circumference on both sides of the third receptacle. Splines 118 are positioned on the middle portion of the circumference of third receptacle 110. When the coupling is formed, these members are positioned with the second end 108 of second member positioned with third receptacle 108 positioned coaxially with first and second receptacles 86 and 88.

Figure 6:
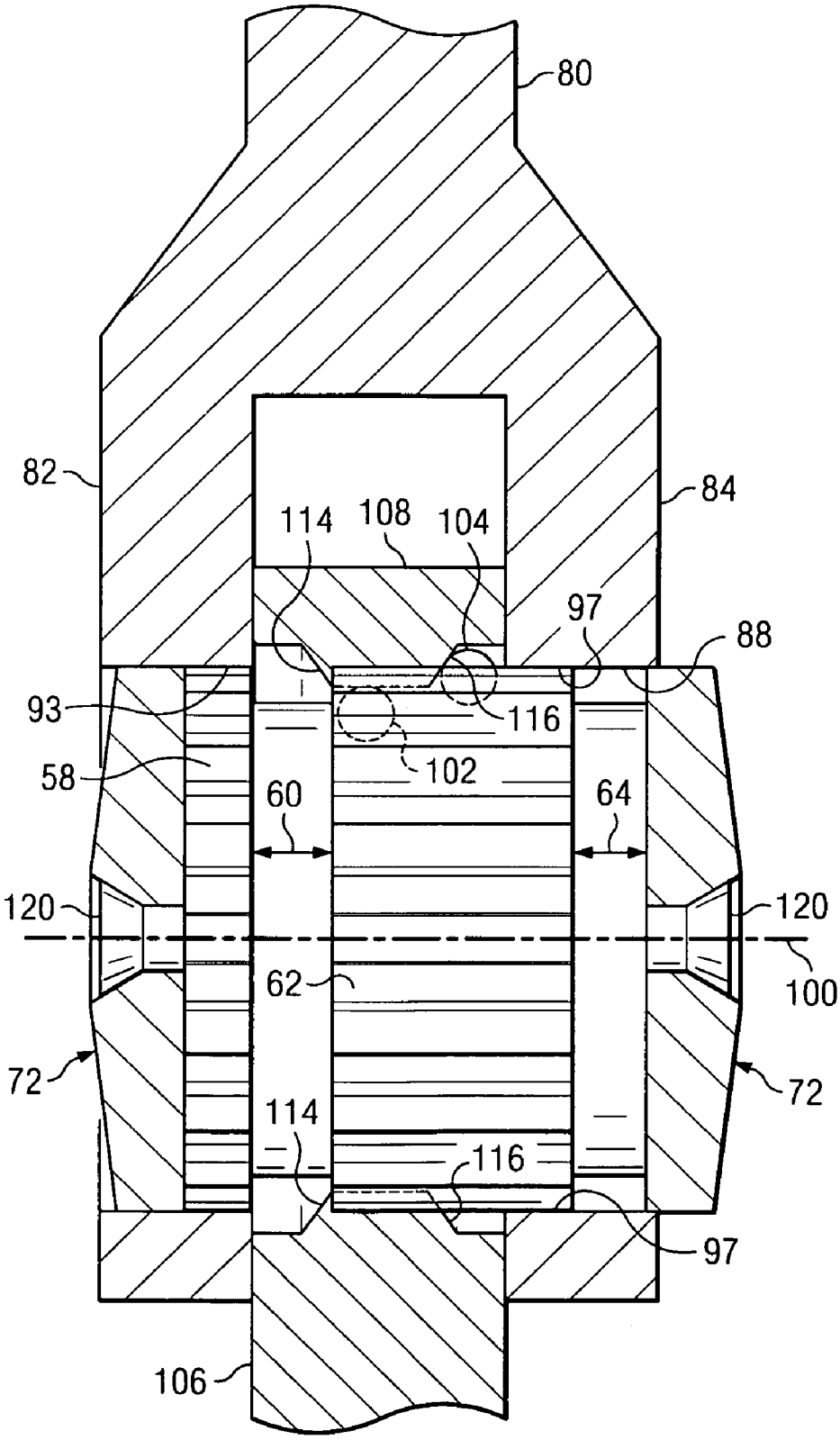
FIG. 6 is a schematic diagram of the members shown in FIGS. 4 and 5 in combination with the pin in place in a locked position.
Figure 7:
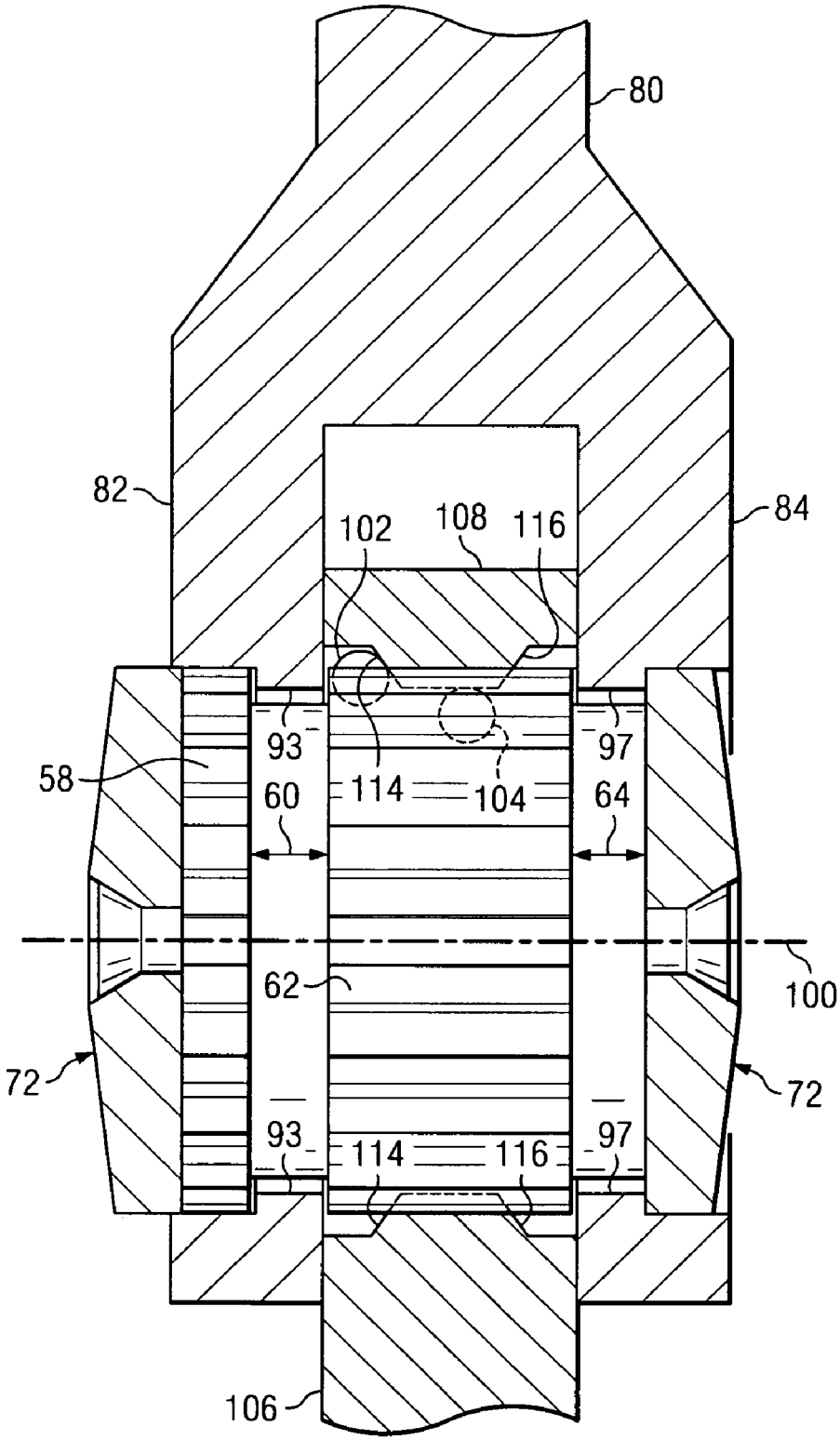
FIG. 7 is a schematic diagram of the members of FIGS. 4 and 5 in combination with the pin in a released position.

In FIG. 6 a pin, as previously described, is positioned through receptacles 86 and 88 and third receptacle 110. As shown in FIG. 6 ball bearing 104 is positioned in an outwardly extended position from second row of splines 62 in bevel 116. In this position, first receptacle row of splines 93 and second receptacle row of splines 97 are positioned in engagement with first row of splines 58 and second row of splines 62 on the pin. This ball bearing, which is desirably extended from about 50 to about 65 percent of its diameter outwardly from the receptacle in which it is positioned in the pin as now positioned in bevel 116 maintains the pin in this position. To change this positioning, the pin may be pushed through the receptacle until ball bearing 102 is positioned in bevel 114 in which position splined rows 93 and 97 are located in first space 60 and second space 64, as shown in FIG. 7. In this position, the wrench is released and the members can be rotated relative to each other. It will be noted that there is no significant protrusion of either of the sides of the pin from the outside of member 80. This pin arrangement does not require any springs for its operation.

Desirably the ball bearings are about 0.063 inches in diameter, although other sizes could be used, especially if larger pins are desired. Typically, the first row of splines 58 is approximately 0.063 inches in width with first space 60 being slightly wider so that splines 58 can rotate freely in space 60. Second space 64 is also of approximately the same diameter. Typically the ball bearings are positioned about 0.063 inches apart so that the rows of splines are readily moved from engagement into the bevels by simply pushing the pin through the coupling.

By the use of the adjustable tool of the present invention, there are no protruding members above or below the coupling and the coupling can be used in either a horizontal or a vertical position on a wrench or tool. As shown in FIG. 1 and FIG. 2, the coupling is clearly horizontal as positioned on the tool in FIG. 1 and is clearly vertical as positioned in the tool shown in FIG. 2.

In the embodiments shown in FIGS. 6 and 7, the ends are retained in position by screws 120. As also shown in FIGS. 1 and 2 the pin receptacles and all other receptacles are coaxially positioned. This connection is a very effective connection and is readily used to produce tools of any desired type. In other words, a handle can be attached to either the first or second member. Similarly a tool can be attached to either the first or the second member. It is immaterial whether the tool is attached to the member having the two receptacles or whether it is attached to member 106, which has a single shaft.

While substantially any coupling could be used which will allow for the adjustment of the multi-coupling containing wrench, as discussed above, it is preferred that a coupling such as discussed above which is positively moved to either a rotatable or a locked position be used. Further it is considered that couplings such as discussed above, since they do not require springs are somewhat more durable than couplings which do require springs and are somewhat less susceptible to damage than coupling which have protruding parts. In any event, Applicant is unaware of any wrenches which use a plurality of couplings to permit a selected configuration of the wrench to reach difficultly reachable areas for operation.

Figure 9:
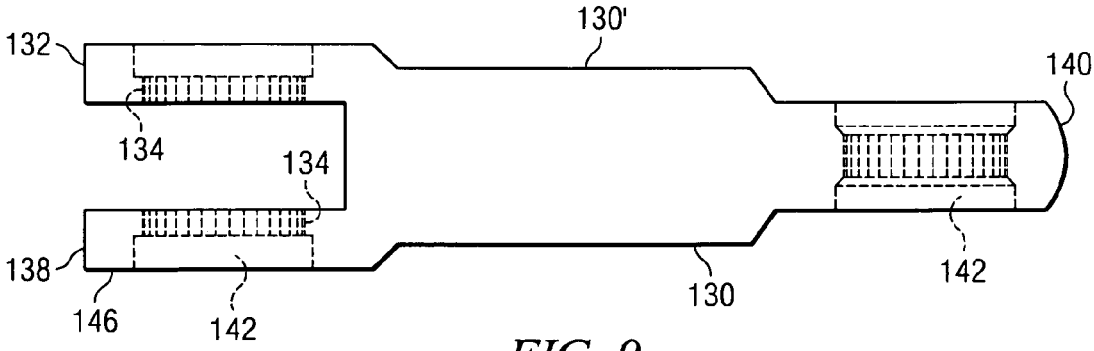
FIG. 9 shows is a top view of the link shown in FIG. 8.

According to the present invention, such is accomplished with relative ease. It is clear that, as shown in FIG. 1, the handle and the wrench could be reversed since it is immaterial whether the two extension ends or the single extended member end of the link shown in FIG. 9 is used to engage the handle or the wrench. By the use of the multi-couplings, tailored tools can be produced to access almost any area for the performance of operations in the area.

Figure 8:
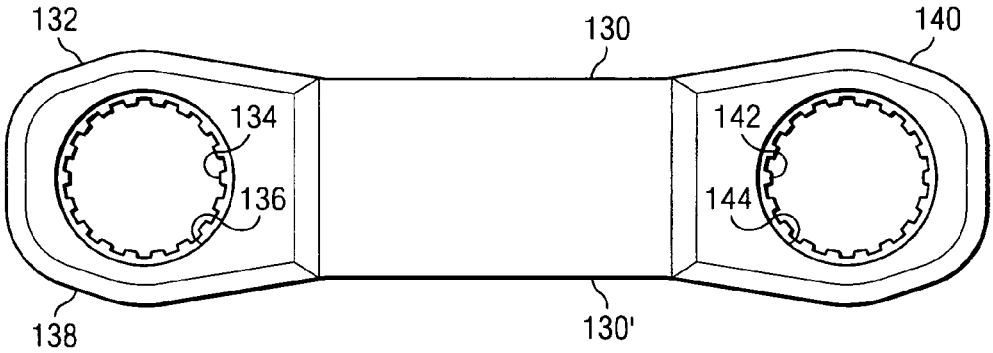
FIG. 8 shows a link functional to link two couplings.

FIGS. 8 and 9 show links suitable for use in the present invention. In FIG. 8 a top view of a suitable link is shown. The ends of the link are basically a top view of the cross-sectional ends shown in FIGS. 4 and 5. In link 130 a shaft or other suitable member 131 is shown connecting an extension 132, as previously referred to, including a receptacle 134, which includes splines 136 at a first end 138 of link 130. A second end 140, a second receptacle 142 is shown showing splines 144. The receptacles 134 and 142 can be used either for mating connection to a tool with a pin, as discussed above, or to another link. As also discussed previously, any suitable pin may be used which is suitable to releasably disengage and engage the connected members at a coupling.

FIG. 9 is a top view of the link shown in FIG. 8 and shows a top view of extension 132 and a second extension 146. These extensions are positioned at end 138 of link 130 and receptacles 134 are positioned through extensions 132 and 146, as discussed above. At second end 140, a receptacle 142 is shown. These links simply represent extensions of handle and tool linking material having ends as shown in FIGS. 4 and 5 in greater detail. These links are designed to matingly engage each other with a pin as discussed above positioned through the receptacles.

As discussed previously, any suitable pin arrangement can be used which is suitable to release the ends of the links from the mating connection to which they are linked for rotatable movement relative to the other pin and the like. Desirably, the pins used do not require springs or result in protrusions above the tops of the links. Clearly the links can be used either in a horizontal position of in a vertical position to extend the space between a tool handle and a tool. In many instances, a single or double link will be sufficient to achieve the desired configuration, although additional couplings could be used.

While the present invention has been described by reference to certain of its preferred embodiments, it is pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

What is claimed is:

1. An adjustable tool having a plurality of couplings and at least one link positioned between a tool handle and a tool head, the adjustable tool comprising:

a first member having a first extension having there-through a receptacle and a second extension having there-through a receptacle, the receptacle of each of the first extension and second extension having a smooth beveled circumferential portion positioned near an outer circumferential portion thereof and a row of splines positioned on an inner circumferential portion thereof, the receptacles of the first extension and second extension having a common axis;

a first link having a first end and a second end, the first end having a receptacle there-through, the receptacle having a first smooth beveled circumferential portion, then a centered row of splines positioned on the middle circumferential portion, and then a second smooth beveled circumferential portion;

the first extension and second extension being spaced so as to receive therein-between the first link, the first end of the first link being positioned between the first extension and the second extension of the first member along the common axis of their receptacles;

a first pin being generally cylindrical in shape, having a first end, corresponding to a first cylindrical base, a second end, corresponding to a second cylindrical base, the first end and second end of the first pin each having a center located through the axis of the first pin, and an outside, being the lateral area of the first pin;

the outside of the first pin having two circumferential splined portions and two circumferential smooth gaps proximate the first end, a first row of splines having a predetermined width, then a first smooth gap slightly wider than the first row of splines and being positioned next to the first row of splines, then a second row of splines having a predetermined width greater than, and positioned adjacent to the first smooth gap, and then a second smooth gap positioned adjacent to the edge of the second row of splines and adjacent to the second end;

the first pin further including therein a first ball bearing and a second ball bearing, each having a corresponding spring, wherein, in the assembled tool, each ball bearing and spring is positioned in a respective cylindrical bore, the opening of each such bore being adjacent to each other and arranged along the central axis of the first pin, each bore itself being perpendicular to the central axis of the first pin, each bore having a diameter slightly exceeding that of its respective ball bearing, the depth of each bore being less than that of its respective uncompressed spring, both bores further being positioned in the second row of splines of the first pin, each ball bearing being maintained in an outwardly biased position by its respective spring positioned beneath its respective ball bearing in its respective bore;

the center of the first end and the second end of the first pin each further having a recess and a screw receptacle for receiving a respective end cap, each such end cap having a protrusion which mates with the respective recess of the first pin and is coupled thereto;

the first pin rotatably coupling the first member to the first link by being coaxially positioned through each of the receptacle of the first extension, the receptacle of the first end of the first link and the receptacle of the second extension of the first member, the splines of the first pin being matingly engaged with the inner splines positioned on the inner circumferential portions of the receptacle of the first extension, the receptacle of the first end of the first link and the receptacle of the second extension, so that the first member and the first link are coupled to be rotatable relative to each other or so that the first member and the first link are locked relative to each other, wherein the first pin does not substantially protrude above or below the first coupling;

the position of the second row of splines of the first pin, and hence the position of the first ball bearing and the second ball bearing with respect to the position of the smooth gaps and splines of the first link, dictating whether the first member and the first link are rotatable with respect to each other or are locked;

the combination of the first extension and second extension of the first member, the first end of the first link, and the first pin and its appurtenances coaxially aligned there-through being collectively, a first coupling;

a second member;

a second pin; and the second member connected to the second end of the first link via the second pin co-axially positioned through a receptacle at a second coupling so that the first link and the second member are rotatable relative to each other or so that the first link and the second member are locked relative to each other, wherein the second pin does not substantially protrude above or below the first coupling.

2. The tool of claim 1 wherein the first member is a handle and the second member is a tool.

3. The tool of claim 1 wherein first member is a tool and the second member is a handle.

4. The tool of claim 1 wherein the tool comprises a wrench.

5. The tool of claim 1 wherein the tool comprises a pry bar.

6. The tool of claim 1, wherein, when locked, a first ball bearing is positioned in an outwardly extended position from the second row of splines into one of the smooth beveled portion at the first end of the first link and the second ball bearing is matingly engaged with the splines of the first end of the first link;

the row of splines in the receptacle of the first extension and the row of splines in the receptacle of the second extension are positioned in engagement with first row of splines and second row of splines on the first pin;

the first ball bearing is desirably extended from about 50 to about 65 percent of its diameter outwardly from the receptacle in which it is positioned in the first pin and positioned in the smooth beveled portion so as to maintain the first pin in this position.

7. The tool of claim 1, wherein, when unlocking the tool, the end of the first pin is pushed through the receptacle until a second ball bearing is positioned in a smooth beveled portion at the first end of the first link, and in which the splined rows of the first extension of the first member and splined rows of the second extension of the first member are positioned, respectively, in a the first smooth gap and second smooth gap, such that the first member and the first link can be rotated relative to each other and wherein there is no significant protrusion of either of the sides of the pin.

8. The tool of claim 1, wherein each ball bearings is about 0.063 inches in diameter.

9. The tool of claim 1, wherein the first row of splines on the first pin is approximately 0.063 inches in width with first gap being slightly wider so that the first row of splines on the fist pin can rotate freely in the space formed by the first smooth beveled circumferential portions of the first extension.

10. An adjustable tool wherein a plurality of couplings and at least two links are positioned between a tool handle and a tool head, the adjustable tool comprising:

a first member having a first extension having there-through a receptacle and a second extension having there-through a receptacle, the receptacle of each of the first extension and second extension having a smooth beveled circumferential portion positioned near an outer circumferential portion thereof and a row of splines positioned on an inner circumferential portion thereof, the receptacles of the first extension and second extension having a common axis;

a first link having a first end and a second end, the first end having a receptacle there-through, the receptacle having a first smooth beveled circumferential portion, then a centered row of splines positioned on the middle circumferential portion, and then a second smooth beveled circumferential portion;

the first extension and second extension being spaced so as to receive therein-between the first link, the first end of the first link being positioned between the first extension and the second extension of the first member along the common axis of their receptacles;

a first pin being generally cylindrical in shape, having a first end, corresponding to a first cylindrical base, a second end, corresponding to a second cylindrical base, the first end and second end of the first pin each having a center located through the axis of the first pin, and an outside, being the lateral area of the first pin;

the outside of the first pin having two circumferential splined portions and two circumferential smooth gaps proximate the first end, a first row of splines having a predetermined width, then a first smooth gap slightly wider than the first row of splines and being positioned next to the first row of splines, then a second row of splines having a predetermined width greater than, and positioned adjacent to the first smooth gap, and then a second smooth gap positioned adjacent to the edge of the second row of splines and adjacent to the second end;

the first pin further including therein a first ball bearing and a second ball bearing, each having a corresponding spring, wherein, in the assembled tool, each ball bearing and spring is positioned in a respective cylindrical bore, the opening of each such bore being adjacent to each other and arranged along the central axis of the first pin, each bore itself being perpendicular to the central axis of the first pin, each bore having a diameter slightly exceeding that of its respective ball bearing, the depth of each bore being less than that of its respective uncompressed spring, both bores further being positioned in the second row of splines of the first pin, each ball bearing being maintained in an outwardly biased position by its respective spring positioned beneath its respective ball bearing in its respective bore;

the center of the first end and the second end of the first pin each further having a recess and a screw receptacle for receiving a respective end cap, each such end cap having a protrusion which mates with the respective recess of the first pin and is coupled thereto;

the first pin rotatably coupling the first member to the first link by being coaxially positioned through each of the receptacle of the first extension, the receptacle of the first end of the first link and the receptacle of the second extension of the first member, the splines of the first pin being matingly engaged with the inner splines positioned on the inner circumferential portions of the receptacle of the first extension, the receptacle of the first end of the first link and the receptacle of the second extension, so that the first member and the first link are coupled to be rotatable relative to each other or so that the first member and the first link are locked relative to each other, wherein the first pin does not substantially protrude above or below the first coupling;

the position of the second row of splines of the first pin, and hence the position of the first ball bearing and the second ball bearing with respect to the position of the smooth gaps and splines of the first link, dictating whether the first member and the first link are rotatable with respect to each other or are locked;

the combination of the first extension and second extension of the first member, the first end of the first link, and the first pin and its appurtenances coaxially aligned there-through being collectively, a first coupling;

a second link having a first end and a second end;

a second coupling being between the first end of the second link and the second end of the first link;

a second pin;

the first end of the second link being connected to the second end of the first link via the second pin co-axially positioned through a receptacle at the second coupling so that the first link and the second link are rotatable relative to each other or so that the first link and the second link are locked relative to each other, wherein the second pin does not substantially protrude above or below the first coupling or the second coupling;

a second member having a first end;

a third coupling being between the first end of the second member and the second end of the second link;

a third pin; and the second member connected to the second end of the second link via the third pin co-axially positioned through a receptacle at the third coupling so that the second link and the third member are rotatable relative to each other or so that the second link and the third member are locked relative to each other, wherein the third pin does not substantially protrude above or below the first coupling, second coupling or third coupling.

11. The tool of claim 10 wherein the first member is a handle and the second member is a tool.

12. The tool of claim 10 wherein first member is a tool and the second member is a handle.

13. The tool of claim 10 wherein the tool comprises a wrench.

14. The tool of claim 10, wherein the tool comprises a pry bar.

15. The tool of claim 10, further comprising a respective end cap on each end of each pin, each end cap including a protrusion which mates with the recess on the pin and is formed for connection to a respective end of a pin by a screw which is seated in a bevel and positioned through a screw opening into a screw receptacle.

16. The tool of claim 10, wherein, when locked, a first ball bearing is positioned in an outwardly extended position from the second row of splines into one of the smooth beveled portion at the first end of the first link and the second ball bearing is matingly engaged with the splines of the first end of the first link;

the row of splines in the receptacle of the first extension and the row of splines in the receptacle of the second extension are positioned in engagement with first row of splines and second row of splines on the first pin;

the first ball bearing is desirably extended from about 50 to about 65 percent of its diameter outwardly from the receptacle in which it is positioned in the first pin and positioned in the smooth beveled portion so as to maintain the first pin in this position.

17. The tool of claim 16, wherein, when unlocking the tool, the end of the first pin is pushed through the receptacle until a second ball bearing is positioned in a smooth beveled portion at the first end of the first link, and in which the splined rows of the first extension of the first member and splined rows of the second extension of the first member are positioned, respectively, in a the first smooth gap and second smooth gap, such that the first member and the first link can be rotated relative to each other and wherein there is no significant protrusion of either of the sides of the pin.

18. The tool of claim 10, wherein each ball bearings is about 0.063 inches in diameter.

19. The tool of claim 10, wherein the first row of splines on the first pin is approximately 0.063 inches in width with first gap being slightly wider so that the first row of splines on the fist pin can rotate freely in the space formed by the first smooth beveled circumferential portions of the first extension.

* * * * *